US007247204B2

(12) United States Patent
Gambini

(10) Patent No.: US 7,247,204 B2
(45) Date of Patent: Jul. 24, 2007

(54) DEVICE FOR METERED DISTRIBUTION OF GLUE ON AN END EDGE OF A LOG, A LOG OR A CORE FOR LOG

(76) Inventor: Giovanni Gambini, Via A. Omodeo 7 - I -56124, Pisa (IT)

( * ) Notice: Subject to any disclaimer, the term of this patent is extended or adjusted under 35 U.S.C. 154(b) by 228 days.

(21) Appl. No.: 11/005,063

(22) Filed: Dec. 6, 2004

(65) Prior Publication Data

US 2006/0180266 A1 Aug. 17, 2006

(30) Foreign Application Priority Data

Dec. 10, 2003 (IT) ..... MI2003A2414

(51) Int. Cl.
*B05C 5/00* (2006.01)
*B05C 1/02* (2006.01)

(52) U.S. Cl. ..... 118/257; 118/325; 118/106; 118/300; 156/446; 156/578

(58) Field of Classification Search ..... 118/300, 118/325, 234, 420, 106, 257, 501; 156/356, 156/357, 446, 450, 455, 456, 187, 578; 427/207.1
See application file for complete search history.

(56) References Cited

U.S. PATENT DOCUMENTS 4,839,202 A * 6/1989 Grassel et al. ..... 427/424
6,620,241 B2 * 9/2003 Gambini ..... 118/257

* cited by examiner

*Primary Examiner*—Chris Fiorilla
*Assistant Examiner*—Yewebdar Tadesse
(74) *Attorney, Agent, or Firm*—James V. Costigan; Hedman & Costigan

(57) ABSTRACT

A device for the metered distribution of glue on an end edge of a log, a log or a core for log comprising a feed (26) for logs (19) or cores (25) towards a wire (12) wound in a closed circuit on at least two end pulleys (13), at least one of which is continuously rotated by a gearmotor (14), a means for the delivery of glue under pressure (30, 40) located above said wire (12) in a position upstream of a wire branch designed to release a strip (21) of glue on an end edge (18) of a log (19), a log (19) or a core (25) for log, in addition to an element (15) for recovery of the glue (20) arranged below a return branch of the wire.

2 Claims, 3 Drawing Sheets

DEVICE FOR METERED DISTRIBUTION OF GLUE ON AN END EDGE OF A LOG, A LOG OR A CORE FOR LOG

The present invention refers to a device for the metered distribution of glue on an end edge of a log, a log or a core for log.

In the field of preparation of toilet rolls, kitchen paper rolls and similar, called logs, glue is currently distributed or positioned in various ways both on the end edge of the single log formed, i.e. on the log itself, or previously on the inner core of the log, if present.

The glue is used in the first case to make the final edge integral with the remaining part of the wound roll and in the second case to ensure that the initial edge of the roll to be formed anchors securely to the core.

This deposit of glue is performed, for example, by passing the end edge or the core through a slot where glue is delivered by a drop spillway.

A further solution features equipment moving from bottom to top and vice versa which draws the glue from the bottom of a container and deposits it on the product to be glued as it passes through a slot of the container open at the top.

Lastly, a further known method is to apply the glue on a log, an end edge of a log or a core by means of a device comprising a wire, wound on two end pulleys, which is immersed in and draws the glue from a container below, said glue being then picked up by the log or core revolving above it.

These known devices do not permit very easy distribution of the glue, or precision metering of it in a controlled way.

For example, due to the fact that the glue is delivered by means of a drop spillway, above which the roll or the core passes, some of the known devices can smear the entire machine and even the roll.

If the glue is drawn from the bottom of the container by means of moving equipment, it is distributed on the log or on the core in doses which are difficult for the user to determine, as they vary according to external factors which are difficult to control.

Lastly, the use of a wire that draws the glue from a container below causes considerable glue metering problems in addition, at times, to the application of an insufficient amount of glue.

The aim of the present invention is therefore to produce a device that permits precision dosing of the amount of glue applied to the log or the core.

A further aim is to produce a device that always guarantees complete distribution of the glue along the entire transverse dimension of the end edge of the log, of the log or of the inner core.

A further aim is to produce a device for performance of the above-mentioned operation which is particularly simple to operate and easy to clean.

These aims according to the present invention are achieved by producing a device for the metered distribution of glue on an end edge of a log, a log or a core for log as described in the attached claim 1.

Further noteworthy characteristics of the present invention are described in the dependent claims.

The characteristics and advantages of a device for the metered distribution of glue on an end edge of a log, a log or a core for log according to the present invention will be more clearly illustrated and evident from the following description, provided as a non-restrictive example, of a form of embodiment with reference to the attached figures in which.

Figure 1:
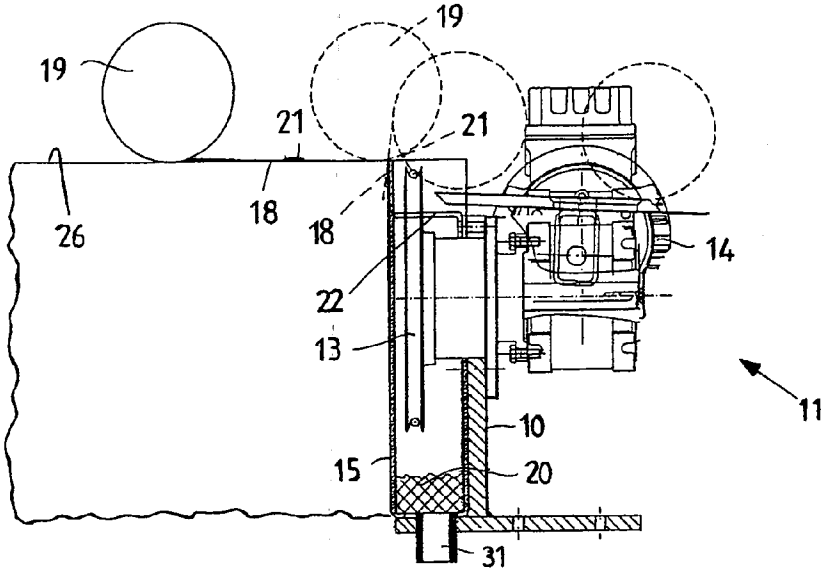
FIG. 1 is a partial section view of a first embodiment of a device according to the present invention with the glue deposited on the end edge of the paper of the log or on a log which is positioned on or arrives from a feed table.
Figure 2:
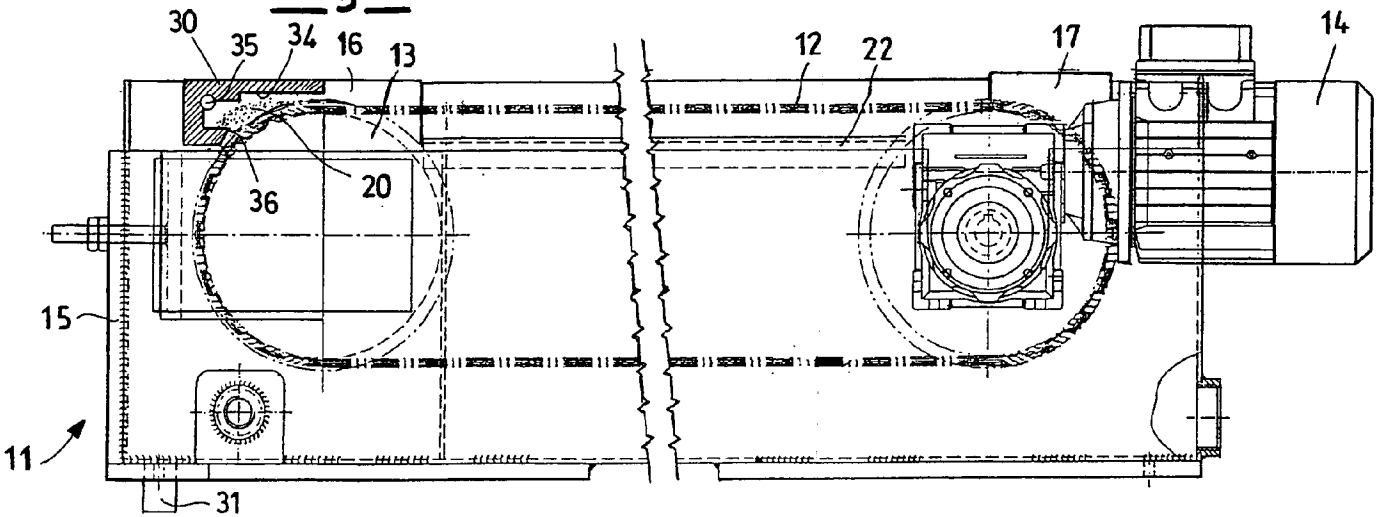
FIG. 2 is a cross section view of the device of FIG. 1.
Figure 3:
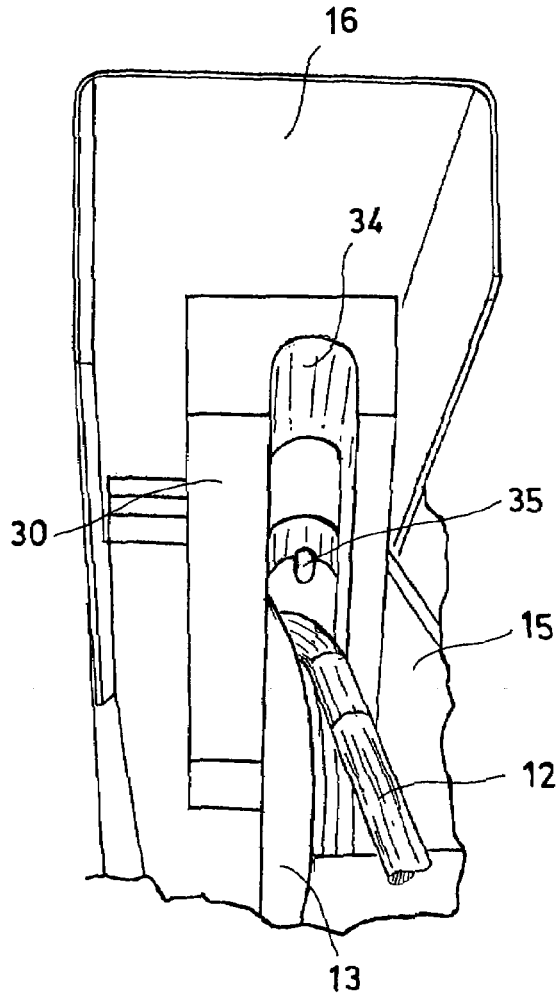
FIG. 3 is a perspective view of an enlarged detail of the device of FIG. 1, in raised position.

With reference firstly to FIGS. 1-3, a device is shown for the metered distribution of glue, indicated overall by reference number 11, designed to apply glue on an end edge 18 of a log 19 or on the log 19 itself from which the edge 18 has been unrolled. The device 11 can be positioned inside any type of machine for the production of logs.

The device 11 comprises downstream of a feed table 26 a wire 12, which is positioned crosswise to the feed direction of the paper being wound and creating the roll, in addition to a means for the delivery of glue under pressure arranged above the wire 12.

The wire 12 in the example is of the closed circuit type, wound on end pulleys 13, in the example two, at least one of which is continuously rotated by a gearmotor 14. The pulleys 13 are supported for rotation on walls 10 of a tank 15 for recovery of glue 20 provided with a discharge duct 31 obtained on the bottom surface of the tank 15, which for example can be slanting towards said duct 31.

The wire 12 comprises an upper branch, from which the end edge 18 of the log 19 or the log 19 picks up a strip 21 of glue 20, and a lower return branch.

In the first embodiment of the device for the metered distribution of glue according to the invention, said delivery means consists of a reservoir 30, containing glue 20 suitable for the above-specified use.

The glue delivery reservoir 30 is provided with one or more holes 35 through which glue 20 is pumped, continuously or intermittently, to regulate metering according to the characteristics of the glue and the product to be glued. The delivery unit 30 releases a certain amount of glue 20 onto the wire 12 in movement; said glue is conveyed by the wire 12 as it moves.

The reservoir 30, as shown in section in FIG. 2 and in the enlarged detail of FIG. 3, in which for the sake of clarity it is shown in a partially raised position, is open at the bottom, i.e. is provided on one lower side with a longitudinal recess or groove 34. The width of the recess 34 is at least equal to the diameter of the wire 12, with the walls, for example the bottom wall, provided with the hole 35 via which the glue 20 is pumped, released in a metered quantity onto the wire 12.

In a preferred embodiment, such as the one shown as an example in FIG. 2, the reservoir 30 is arranged near the end pulley 13, positioned upstream of the upper branch of the wire 12, with its lower delivery side in contact with the wire. The recess 34 is obtained substantially by following the same profile as the portion of wire 12 on which the reservoir 30 is applied or fitted, and therefore in the example is substantially radiused like the pulley 13.

In this embodiment of the reservoir 30 the lower side of it is partially closed, near a lower end of the recess 34, by a wall 36 that partly retains the glue 20 within the reservoir 30 preventing excessive leakage, which is in any case recovered in the tank 15.

In its return path, the wire 12, furthermore, passes over the glue recovery tank 15 or near a general glue recovery element; the latter collects any excess glue which, not picked up by the paper, drips from the wire 12.

For example the tank 15 can be closed like a box and can be provided at its opposite upper ends with closing covers 16 and 17 to protect the pulleys and the means for delivery of glue under pressure. The covers 16 and 17 leave free the outside of the upper branch of the wire 12 which has received and conveys the glue 20.

A central cover 22 is positioned below the upper branch of the wire 12, which deposits the strip 21 of glue on the paper; said cover protects for example from the dust the glue 20 recovered on the bottom of the tank 15.

In a second embodiment, not shown, of a device for the metered distribution of glue according to the present invention, the means for the delivery of glue under pressure consists of a spray or nozzle delivery element positioned above the wire 12 upstream of the upper branch of the wire 12 which transfers the glue onto the log or core. The spray delivery element also releases onto the wire 12 as it moves a certain amount of glue 20, which the wire 12, in movement, takes with it.

Figure 4:
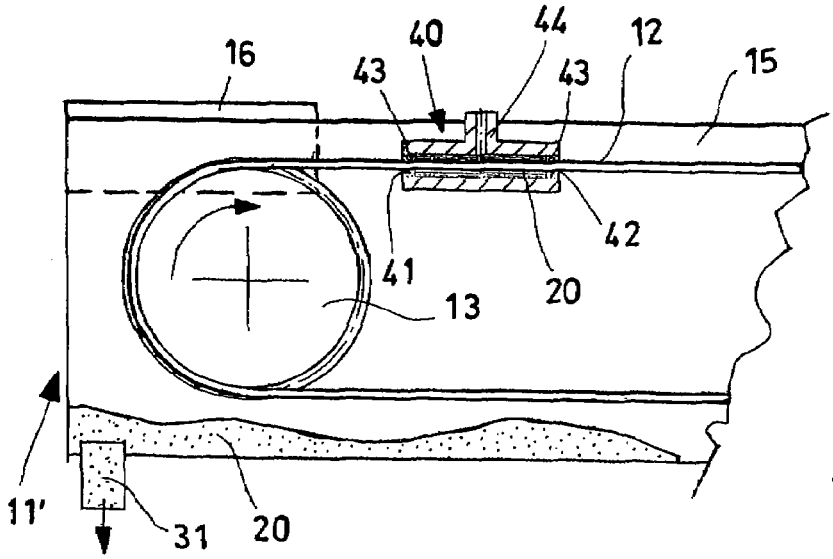
FIG. 4 shows schematically a partially sectioned detail of a second embodiment of a device for the metered distribution of glue according to the present invention.

Lastly, FIG. 4 shows in section a further embodiment of a device 11' for the metered distribution of glue according to the present invention, in which the means for delivery of glue under pressure positioned above the wire 12 consists of a tubular element, or sheath, 40 fitted on a portion of wire 12 upstream or in the initial section of the upper branch, enveloping it circumferentially.

The tubular element 40 comprises an inlet hole 41 and an outlet hole 42 for the wire 12 which have dimensions only slightly larger than the diameter of the wire, and can be different from each other, and which can be provided with seal elements 43.

In particular, the inlet hole 41 must prevent excess outflow or leakage of glue, while the diameter of the outlet hole 42 is such as to ensure precision metering of glue onto the wire.

The glue 20 under pressure is introduced, continuously or intermittently, as described previously, into the tubular element 40 via a channel or sleeve 44.

FIG. 1 shows in a complete line the log 19 arranged on the feed table 26 towards the glue distribution device 11 according to the present invention and with the end edge 18 positioned in front of the log 19 on the feed table 26.

Furthermore, the passage of the roll 19 on the wire 12 and beyond is shown by a broken line.

In this situation the strip of glue 21 is deposited on the roll or log 19, the final edge of which 18 has been unrolled. After passing over the wire 12, the end edge 18, rewound on the log 18, is positioned on the glue 21 and is securely anchored in said position.

According to another possible operating mode the roll or log 19 is made to "jump" beyond the wire so that the end edge 18 receives inside it the strip 21 of glue 20. Said end edge 18 which then rewinds on the roll 19 adheres to it by means of the glue.

Figure 5:
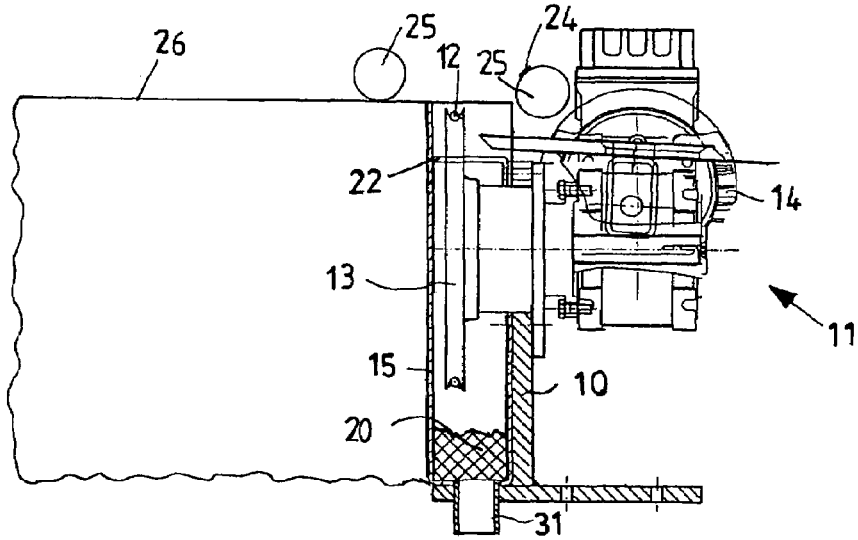
FIG. 5 is a partial section view of a device according to the present invention showing how the device can also be used for the application of glue to a core for positioning inside a log.

FIG. 5 shows how the wire 12, forming part of the device for the metered distribution of glue shown above, can also be used to release a strip 24 of glue 20 onto a core 25 which is provided, when requested, inside the log to be formed.

The core 25 in general is fed to a log formation area by means of a core loader, for example by running on a feed table 26, and before being provided with glue and sent to the area for receipt of the paper unwound from a reel (not shown).

As it passes over the wire 12 of the type as illustrated previously, the core 25 receives the strip 24 of glue 20. Only at this stage is an initial edge (not shown) of the paper fed, thus coupling with the core 25 and beginning to be wound on the core according to the correct arrangement.

It is obvious that the same considerations can be made for a core 25 fed in a direction aligned and parallel to the wire 12, i.e. with the core 25 passing above or below the wire 12. In this case the covers 16 and 17 must be adapted to facilitate passage of the core 25.

It can therefore be seen that a device for the metered distribution of glue on an end edge of a log, a log or a core for log according to the present invention achieves the aims illustrated previously.

The device for metered distribution of glue on an end edge of a log, a log or a core for log according to the present invention has the advantage of improving metering of the glue by the user. In fact, metering of the glue can be adjusted according to the characteristics of the glue itself and the product to be glued, and large amounts of glue can also be metered.

The device according to the invention, furthermore, advantageously permits reduction of splashing and smearing during application of the glue.

The device of the present invention, thus conceived, can be modified and varied in numerous ways, all falling within the scope of the invention. Furthermore, in practice, any materials can be used with any dimensions and components according to technical requirements.

The invention claimed is:

1. A device for the metered distribution of glue on an end edge of a log, a log or a core for a log comprising a feed (26) for logs (19) or a core for a log (25) towards a wire (12) wound in a closed circuit on at least two end pulleys (13), at least one of which is continuously rotated by a gearmotor (14), said device further comprising a means for the delivery of glue under pressure (30, 40) located above said wire (12) in a position upstream of a wire branch designed to release a strip (21) of glue on an end edge (18) of a log (19), or a core (25) for a log, in addition to an element (15) for recovery of the glue (20) arranged below a return branch of the wire said means for delivery of glue under pressure comprising a delivery reservoir (30) for the glue (20) positioned above said wire (12) and provided on a lower side with a recess (34) with a width at least equal to the diameter of the wire (12), said recess having walls (36) that are provided with at least one hole (35) for delivery of the glue (20), said delivery reservoir (30) being designed to release a quantity of glue (20) onto the wire (12) and is positioned above one of said at least one of two end pulleys (13) unstream of the upper branch of the wire (12), the bottom of said recess (34) having substantially the same profile as the portion of wire (12) to which the delivery reservoir (30) is applied and said at least one hole (35) is provided on the bottom of the recess (34).

2. Device according to claim 1, characterized in that the lower side of said delivery reservoir (30) is partially closed near a lower end of said recess (34) by a wall (36) adapted to partially retain the glue (20) within said delivery reservoir (30).

* * * * *